US009624752B2

(12) United States Patent
Resink

(10) Patent No.: US 9,624,752 B2
(45) Date of Patent: Apr. 18, 2017

(54) SEAL AND ASSEMBLY COMPRISING THE SEAL AND METHOD FOR APPLYING THE SEAL

(71) Applicant: Ruma Products Holding B.V., Hoogeveen (NL)

(72) Inventor: Sjoerd Resink, Hoogeveen (NL)

(73) Assignee: RUMA PRODUCTS HOLDING B.V., Hoogeveen (NL)

( * ) Notice: Subject to any disclaimer, the term of this patent is extended or adjusted under 35 U.S.C. 154(b) by 0 days.

(21) Appl. No.: 14/873,391

(22) Filed: Oct. 2, 2015

(65) Prior Publication Data

US 2016/0097252 A1 Apr. 7, 2016

(30) Foreign Application Priority Data

Oct. 3, 2014 (NL) ..... 2013568

(51) Int. Cl.
*E21B 33/126* (2006.01)
*E21B 33/12* (2006.01)

(52) U.S. Cl.
CPC ..... *E21B 33/126* (2013.01); *E21B 33/1208* (2013.01)

(58) Field of Classification Search
CPC ..... E21B 33/126; E21B 33/1208
USPC ..... 166/387
See application file for complete search history.

(56) References Cited

U.S. PATENT DOCUMENTS 2,581,981 A 1/1952 Taylor, Jr.
4,424,865 A * 1/1984 Payton, Jr. ..... E21B 33/1208 138/89
7,819,200 B2 * 10/2010 Cornelissen ..... E21B 33/1208 166/179
7,891,431 B2 * 2/2011 Freyer ..... E21B 33/1208 166/119
7,971,640 B2 * 7/2011 Freyer ..... E21B 33/128 166/196
9,140,095 B2 * 9/2015 Northam ..... E21B 33/126
9,163,474 B2 * 10/2015 Ramon ..... E21B 33/1212
(Continued)

FOREIGN PATENT DOCUMENTS

NL WO 2013095093 A1 * 6/2013 ..... E21B 33/1208
WO 03/008756 A1 1/2003
(Continued)

OTHER PUBLICATIONS

European Patent Office; International Search Report and Written Opinion; Netherlands Application No. NL 2013568; Jun. 15, 2015.

*Primary Examiner* — Matthew R Buck
(74) *Attorney, Agent, or Firm* — Jackson Walker LLP

(57) ABSTRACT

A seal including a seal wall comprising a swelling polymer material having elastomeric properties so that the seal has a non-swollen state and an expanded state, the seal wall having a closed circumference that extends around a central longitudinal axis and that extends from a first end via an intermediate section to a second end along a length (L) in the direction of the central axis (A), wherein the first end of the seal sleeve wall is connected or connectable to the inner element and wherein the seal wall, apart from at and adjacent to the first end thereof, is freely radially expandable due to the fact that the second end and the intermediate section of the seal wall are not connected to any structural parts.

26 Claims, 8 Drawing Sheets

(56) References Cited

U.S. PATENT DOCUMENTS

| | | | | |
|---|---|---|---|---|
| 2004/0194971 | A1* | 10/2004 | Thomson | E21B 33/14 166/387 |
| 2007/0056735 | A1* | 3/2007 | Bosma | C09K 8/508 166/295 |
| 2007/0261863 | A1 | 11/2007 | Macleod et al. | |
| 2014/0102727 | A1 | 4/2014 | Northam et al. | |
| 2015/0021044 | A1* | 1/2015 | Davis | E21B 33/1208 166/378 |

FOREIGN PATENT DOCUMENTS

| | | | |
|---|---|---|---|
| WO | 2011/020987 | A2 | 2/2011 |
| WO | 2013/095093 | A1 | 6/2013 |
| WO | 2013/095098 | A1 | 6/2013 |

* cited by examiner

SEAL AND ASSEMBLY COMPRISING THE SEAL AND METHOD FOR APPLYING THE SEAL

FIELD

The invention relates to a seal, more particularly to a swelling seal that may, for example, be used in a bore hole from a well to provide a seal between an inner and an outer element such as a tubular and a well bore.

BACKGROUND

Swelling seals are well from, for example, WO03/008756 and US2007/0056735. These documents disclose seals with an annular form and a cylindrical wall having a radial wall thickness in a non-swollen state and an increased radial wall thickness in an expanded state. The sealing effect takes place by swelling, which transfers the seal from the non-swollen to an expanded state, the increased radial wall thickness providing the sealing effect. The maximum increase in radial wall thickness is determined by an absolute swell. The disadvantage of these swelling seals is that the absolute swell limits the width of an annular space that can be bridged and then sealed. This is caused by the fact that an annular space with a considerable width also requires a seal with a considerable radial wall thickness in a non-swollen state. However, a seal with a considerable radial wall thickness in a non-swollen state may be difficult to be transported to the annular space where it has to perform its sealing function due its thickness in a non-swollen state. In many cases the annular space where the sealing is required is several hundred meters downhole inside the bore hole from a well. A seal with a large diameter in the non-swollen state is not always desirable or practical.

In order to remove this disadvantage, WO2013/095093 discloses a seal sleeve having a bellow-shaped seal wall of swelling material. In an expanded state, the slanted seal wall parts of the bellow that extend radially outwardly not only become thicker due to the swelling but also increase in length in a radial direction, so that the radial width of the annular space that may be closed off can be larger. The radially outward extending wall parts cover a distance multiple times the wall thickness of the seal wall. The bellow shaped seal wall must be rather thin to obtain a good bellow configuration. However, a thin seal wall has a limited strength, which may be disadvantageous for some applications.

Although the seal disclosed in WO2013/095093 may be used to seal annular spaces with a considerable width, due to the slanted wall sections, it still has a considerable thickness in a non-swollen state.

WO2011/020987 discloses a pressure control device for isolating a section of a conduit, the device comprising a support member, a flexible cup member mounted to the support member and a first swellable element. The first swellable element adapted, upon activation by an activation fluid, to urge a first portion of the cup member outwards into engagement with a conduit surface. The first swellable element includes at least one bypass arranged to permit the activation fluid to bypass the swellable element and build up behind a second portion of the cup member. The second cup member portion is adapted to be moved under the action of the fluid pressure into engagement with the conduit surface. The pressure control device known from WO2011/020987 is complicated in that it requires at least three parts, i.e. a support member, a flexible cup member and a swellable element. Additionally, bypasses are required to transport fluid to an annulus downstream of the swellable element so that is contacts a middle section of the flexible cup member. By virtue of fluid pressure build up in the annulus downstream of the swellable element, i.e. not by virtue of swelling, the middle section of the flexible cup is forced into engagement with the wellbore surface. When the fluid pressure is low, the sealing action of the pressure control device will be poor. The complicated structure makes the known pressure control device costly and difficult to manufacture.

SUMMARY OF THE INVENTION

The object of the invention is to provide an improved seal that, at a given diameter in a non-swollen state provides the possibility to seal annular spaces with a considerable larger radial width than the prior art swelling seals and that has a relatively simple construction. To that end, the invention provides a seal including a seal wall of a swelling polymer material having elastomeric properties so that the seal has a non-swollen state and an expanded state, the seal wall having a closed circumference that extends around a central longitudinal axis and that extends from a first end via an intermediate section to a second end along a length in the direction of the central axis, wherein the seal wall is connected or connectable to the inner element, and wherein the seal wall, apart from at and adjacent to the first end thereof, is freely radially expandable due to the fact that the second end and the intermediate section of the seal wall are not connected to any structural parts other than itself.

An advantage of the seal according to the invention is that the second end and the intermediate section of the seal wall not only increases in radial thickness due to the swelling of the swelling polymer material, but, more importantly, the inner and outer diameter of the second end and the intermediate section are free to increase considerably. This increase of the inner and outer diameter may continue until the outer seal wall surface abuts against an outer element, such as the inner wall surface of a bore hole or a casing in a well bore. Normally, during swelling, the swelling polymer material will expand equally in all directions, including in the tangential direction of the seal wall, in other words in the circumferential direction of the seal wall. By virtue of the fact that the intermediate section and the second end are not connected to any structural part having fixed dimensions, the intermediate section and the second end will undergo an increase in both inner and outer diameter due to the swelling of the swelling polymer material in the circumferential direction. Consequently, the seal wall gradually increases in diameter when viewed in a direction along the central axis from the first end to the second end by the increase of both the inner as well as the outer diameter of the intermediate section and second end of the seal wall. The total radial expansion of the seal wall at the intermediate section and at the second end is therefore a compounded effect from the increasing radial seal wall thickness and the increasing inner and outer diameter of the seal wall due to swelling of the polymer material in the tangential, i.e. circumferential direction of the seal wall. This allows sealing of annular spaces with a considerable radial width, while still allowing using a seal having a seal wall with a relatively small radial wall thickness in a non-swollen state. Having a smaller radial wall thickness in a non-swollen state provides the advantage that an inner element carrying the seal may be transferred through holes having a minimum diameter at certain points along the length of the hole just which is just slightly larger than the outer diameter of the seal, while at the sealing location further downhole the radial width of the annular space that must be sealed may be large relative to said minimum diameter. The ratio between the diameter of the seal in the non-swollen state and the maximum diameter of the seal in the swollen state of the seal may be at least 1:1.3 and preferably at least approximately 1:2. Furthermore, the seal according to the invention can be configured to be fixedly bonded on the inner element, but may also be provided as a seal sleeve that may be adjustably mounted on an inner element, such as production tubing in a well bore hole, a pipe, etc.

The seal wall may, at and adjacent to the first end thereof be directly bonded onto the inner element.

In an embodiment, the seal may include a single connection ring having a fixed structure and being connected at a first end of the seal wall, wherein the single connection ring is configured to provide a connection between the inner element and the seal. In this embodiment, the seal is, in fact, a seal sleeve that may be connected singularly or in multiples at any position along the length of the inner element such as a tubing or a pipe or a shaft. The connection may be effected by means of welding, gluing, clamping, bolts, etc.

In addition to the seal, the invention also provides an assembly comprising a seal according to the invention, an inner element having an outer surface and an outer element having an inner surface, wherein the inner element is at least partially enclosed by the outer element so that a circumferential space is present that extends between the outer surface of the inner element and the inner surface of the outer element, and wherein the seal wall and the inner wall of the outer element are spaced apart in a non-swollen state of the seal, and wherein in an expanded state of the seal the seal wall is in sealing engagement with the outer surface from the inner element at least at or adjacent the first end the seal wall and wherein the seal wall is in sealing engagement with the inner wall of the outer element at least at or adjacent the second end of the seal wall.

Also, the invention provides a method for applying a seal between an inner element and an outer element, the method comprising:

- providing an inner element having an outer surface and an outer element having an inner surface, wherein the dimensions of the inner element are such that it is receivable in the outer element,
- providing a seal according to the invention that is mounted on the inner element,
- inserting the inner element into the outer element, so that a circumferential space is present between the seal and the outer element,
- applying a fluid to the circumferential space to change the state of the seal from a non-swollen state to an expanded state, wherein, in the expanded state of the seal, the seal wall is in sealing engagement with the outer surface from the inner element at least at or adjacent the first end the seal wall and wherein the seal wall is in sealing engagement with the inner wall of the outer element at east at or adjacent the second end of the seal wall.

Various embodiments are claimed in the dependent claims and will be further elucidated with reference to some examples shown in the figures. The embodiments may be combined or may be applied separate from each other.

DETAILED DESCRIPTION

Figure 1:
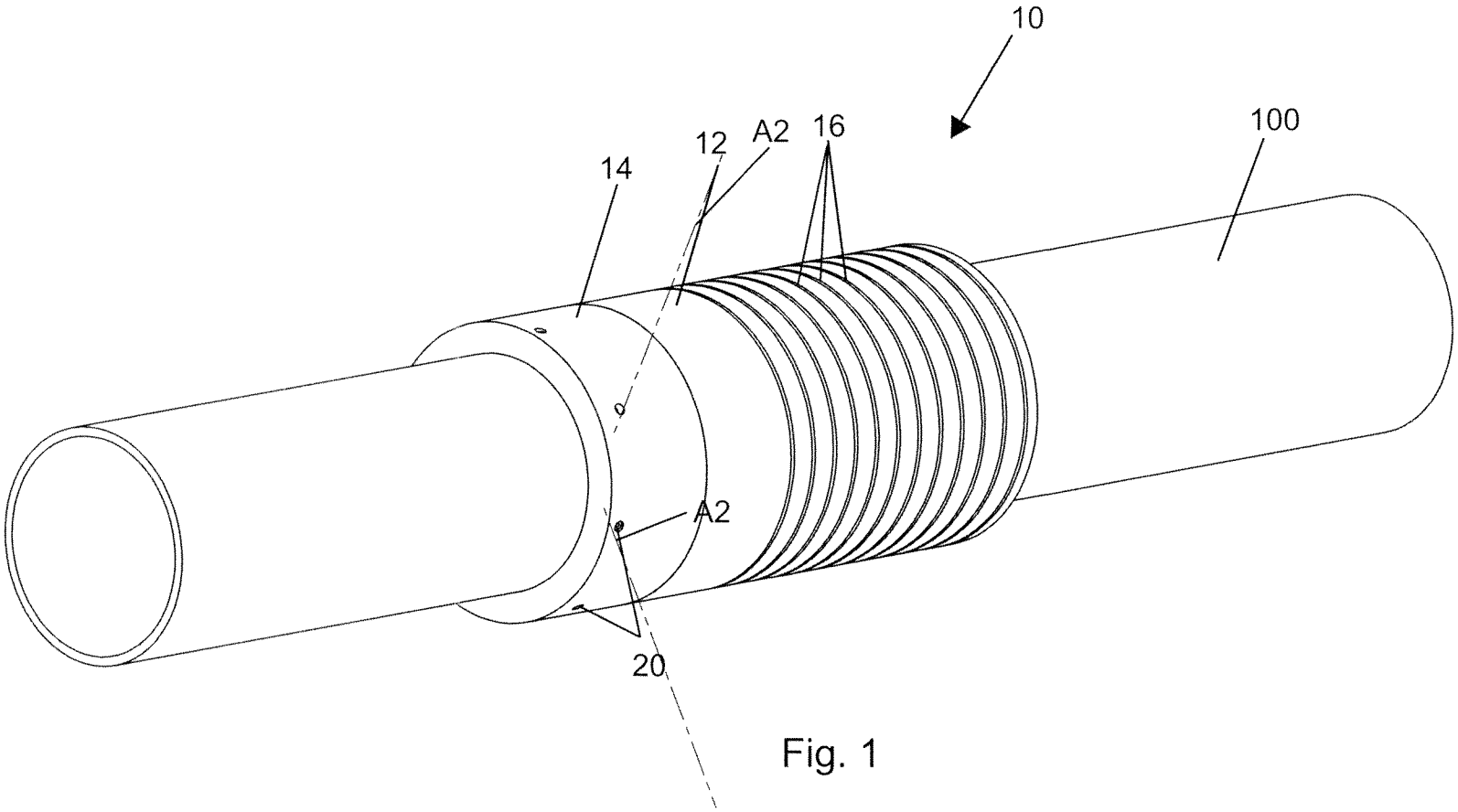
FIG. 1 shows a perspective view of the inner element with a first example of a seal mounted thereon, the seal being in the non-swollen state, wherein, for the sake of clarity, the outer element is not shown.

In this application similar or corresponding features are denoted by similar or corresponding reference signs. The description of the various embodiments is not limited to the examples shown in the figures and the reference number used in the detailed description and the claims are not intended to limit the description of the embodiments but are included to elucidate the embodiments by referring to the examples shown in the figures.

The invention provides a seal 10 that is connected to or connectable to inner element 100. Two examples of the seal 10 are shown in the figures. In general terms the seal 10 includes a seal wall 12 of a swellable polymer material having elastomeric properties so that the seal has a non-swollen state and an expanded state. The seal wall 12 has a closed circumference that extends around a central longitudinal axis A and that extends from a first end 12*a* via an intermediate section 12*c* to a second end 12*b* along a length in the direction of the central axis A. Generally, the seal wall will have a substantially circular cross section in a plane that extends perpendicular to the central axis A. The first end 12*a* of the seal wall 12 is connected or is connectable to the inner element 100. The seal wall 12, apart from at and adjacent to the first end 12*a* thereof, is freely radially expandable due to the fact that the second end 12*b* and the intermediate section 12*c* of the seal wall 12 are not connected to any structural parts other than itself.

The advantages of the seal 10 as described above have been described in the summary section above to which reference is made. By virtue of the radially freely expandable second end 12*b* and intermediate section 12*c*, annular spaces with a relatively large radial width can be sealed with the seal 10 which has in a non-expanded state a relatively small diameter. As a consequence the ratio between the outer diameter of the seal 10 in a non-expanded state and the maximum outer diameter of the seal 10 in the expanded state may be at least 1:1.3 and preferably at least 1:2. Such expansion ratios can not be obtained with the prior art seals or seal sleeves.

The connection between the first end 12*a* of the seal sleeve wall and the inner element 100 may be a direct connection, which may be effected by a direct bond between the inner element 100 and the inner surface of the seal wall 12 at and adjacent the first end 12*a*. In such an embodiment 19, the seal may exclusively consist of the seal wall. No other elements are part of the seal.

In an alternative embodiment, of which two examples are shown in the figures, the seal 10 may additionally include a single connection ring 14 that has a fixed structure and that is connected at a first end of the seal wall 12*a*. The single connection ring 14 may be configured to provide a connection between the inner element 100 and the seal 10. The connection may be effected in various ways, for example, by welding, by clamping, by gluing, by bolts etc. In such an embodiment, the seal itself may exclusively consist of the seal wall and the single connection ring. Of course, bolts or glue may additionally be necessary to connect the connection ring 14 to the inner element 100.

In an embodiment, of which two examples are shown in the figures, apart 12*d* of the seal wall 12 of the seal 10 may also extend at least partly at an inner surface of the connection ring 14. This is clearly visible in FIGS. 4 and 5. The swelling material that extends at the inner surface of the connection ring 14 provides a very secure sealing engagement between the inner element 100 and the seal 10 when the swelling of the seal wall 12 takes place. In fact, the part 12*d* of the seal wall 12 that extends at the inner surface of the connection ring 14 expands and is confined within the space between the outer surface of the inner element 100 and the inner surface of the connection ring 14 so that a secure sealing is obtained in that area. Additionally, the swelled seal wall material extending between the inner element 100 and the connection ring 14 provides a clamping force between the connection ring 14 and the inner element 100 so that the mechanical connection between the seal 10 and the inner element 100 is stronger.

In an embodiment of the invention, of which two examples are shown in FIGS. 1-6, the single connection ring 14 of the seal 10 may include threaded holes 20 in which bolts may be screwed to provide the connection between the inner element 100 and the seal 10. In fact, the seal 10 is then embodied as a seal sleeve 10 that may be mounted anywhere along the length of an inner element 100 such a production tubing for a well or any other pipe. Providing a screw connection allows the connection ring 14 and thus the seal 10 to be disconnected from the inner element, for example for repositioning the seal at the inner element 100 or for removal.

The combination of the embodiment having at least part 12*d* of the seal wall 12 extending under the connection ring 14 and the embodiment having a connection ring 14 provided with threaded holes 20 provides a flexible mounting possibility on the inner element 100 while at the same time secure and durable sealing effect at the connection between the seal 10 and the inner element 100 is obtained.

Figure 3:
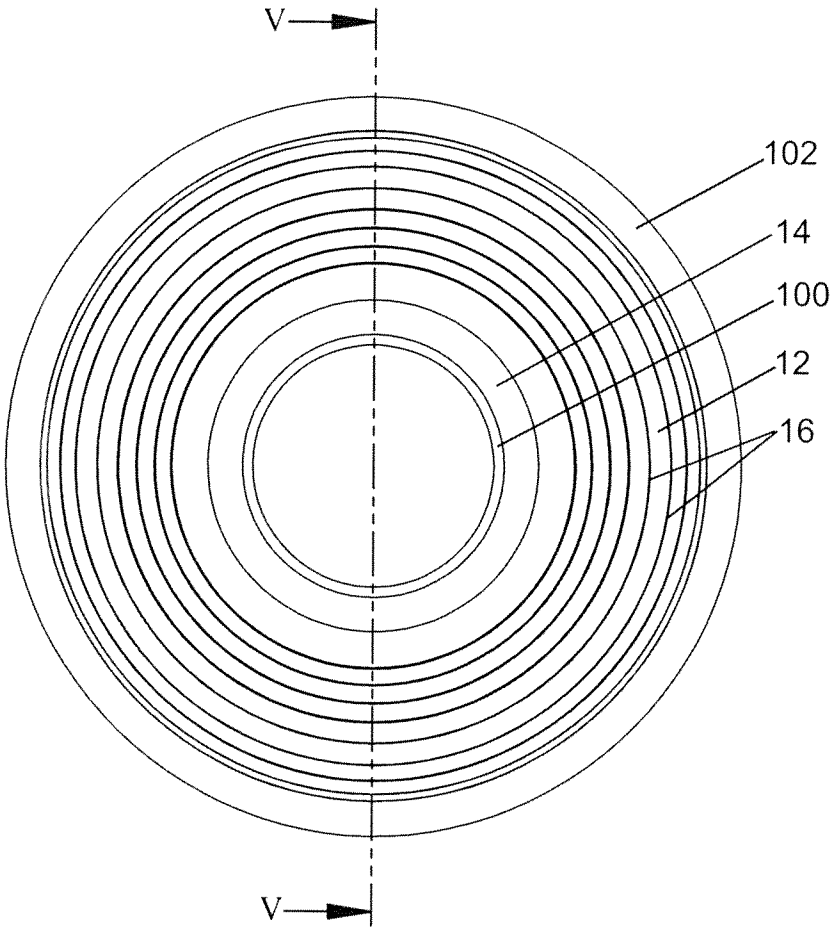
FIG. 3 shows an end view in the longitudinal direction of the assembly of FIG. 2 in which the outer element is shown as well.
Figure 4:
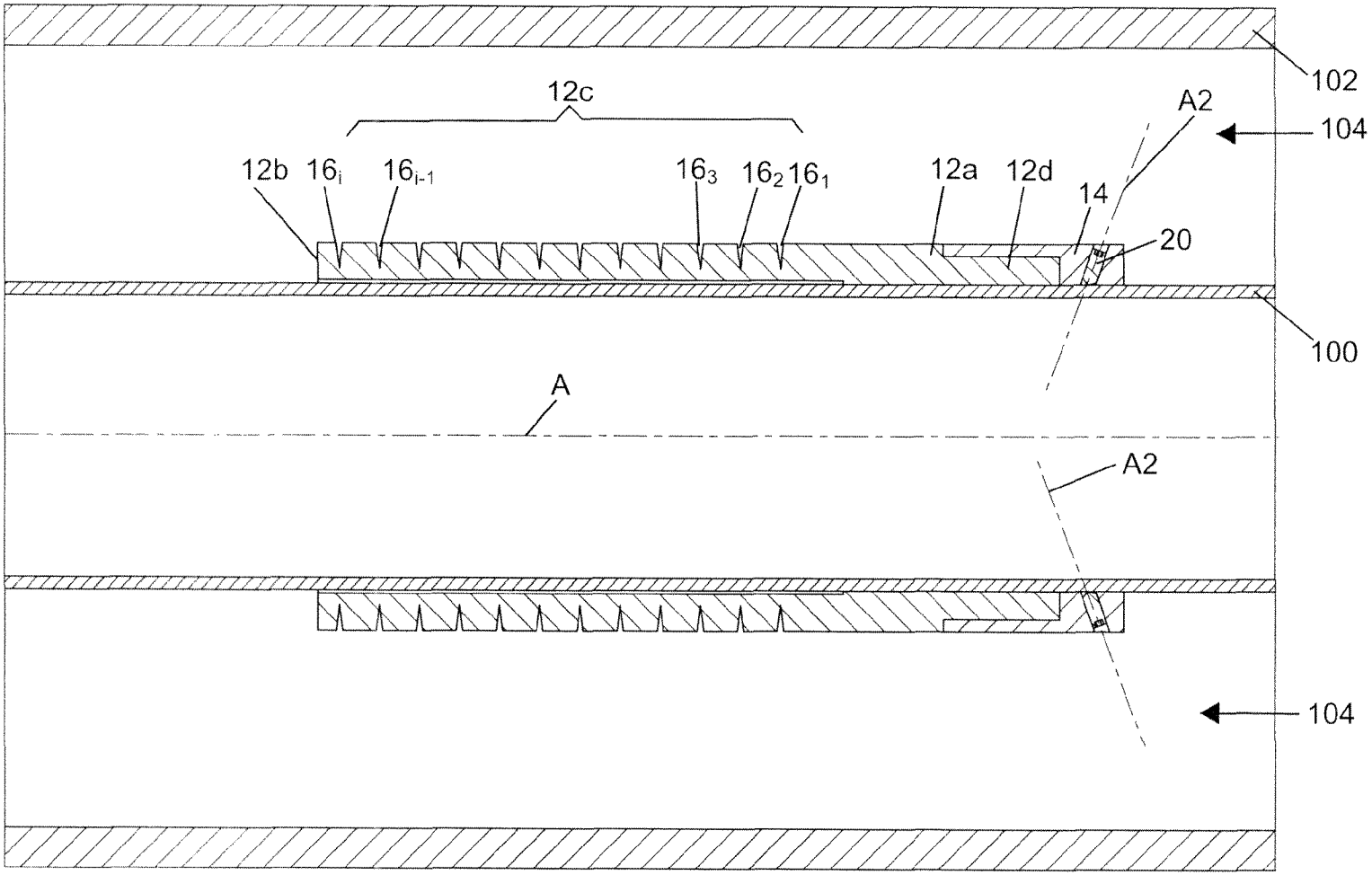
FIG. 4 shows a cross sectional view along line V-V from FIG. 3, however, in a non-swollen state of the seal.

In an embodiment, each threaded hole 20 may extend along an associated screw axis A2. Each associated screw axis A2 may include a sharp angle with the central axis A of the seal wall 12. FIGS. 3 and 4 clearly show the threaded holes 20 and the associated screw axes A2.

By virtue of the sharp angle the contact surface between the inner element 100 and the bolt is diminished resulting in a better, more secure engagement of the bolt on the inner element 100 and thus a more secure connection between the seal 10 and the inner element 100.

In an embodiment, the connection ring 14 may comprise metal or a metal alloy. However, other materials are feasible, such as a fiber reinforced plastic or resin. Instead of connecting the connection ring 14 with bolts to the inner element 100, other ways of connecting are feasible as well, such as gluing, clamping, welding and combinations thereof.

Figure 2:
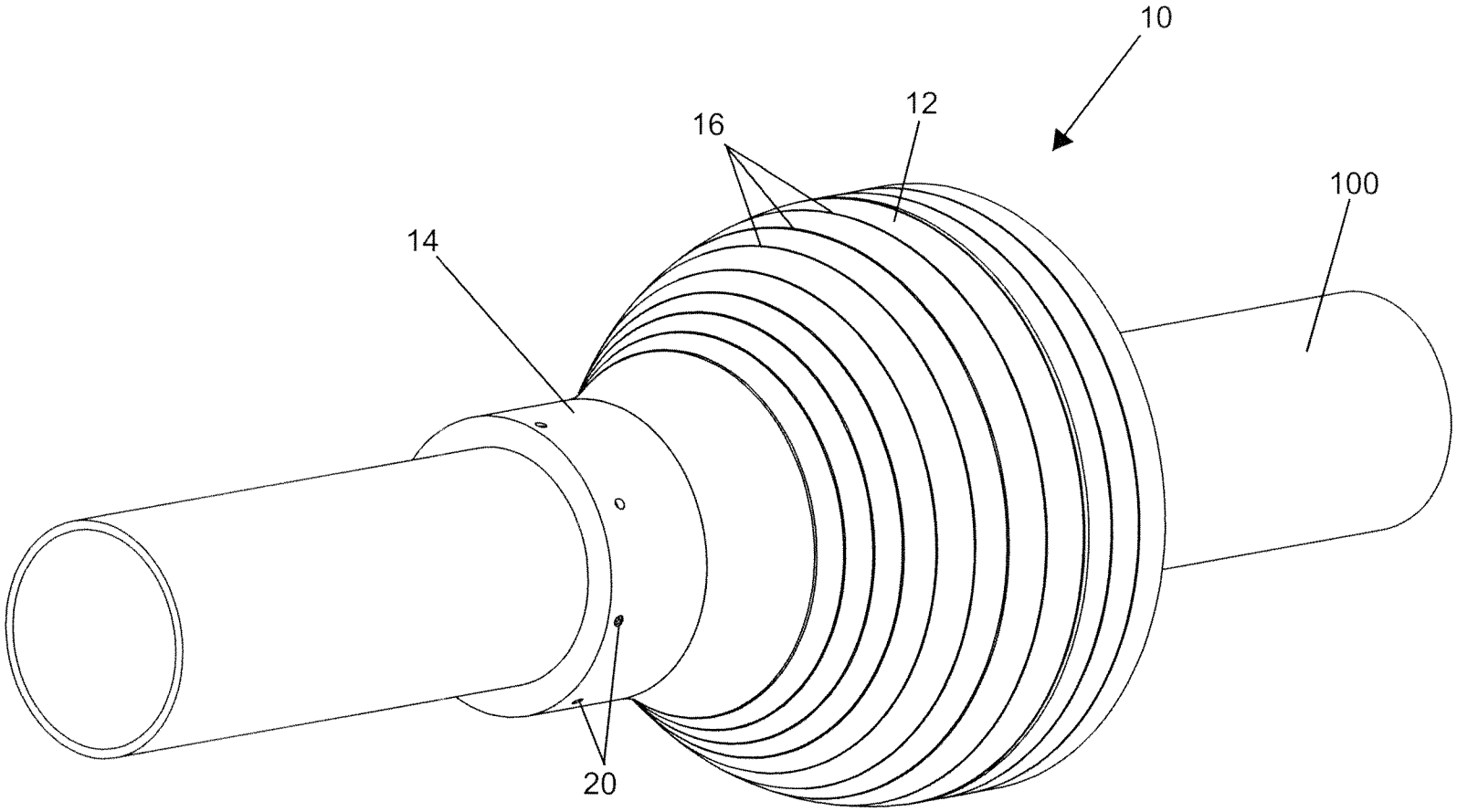
FIG. 2 shows a similar perspective view as FIG. 1 in which the seal is in the expanded state.
Figure 5:
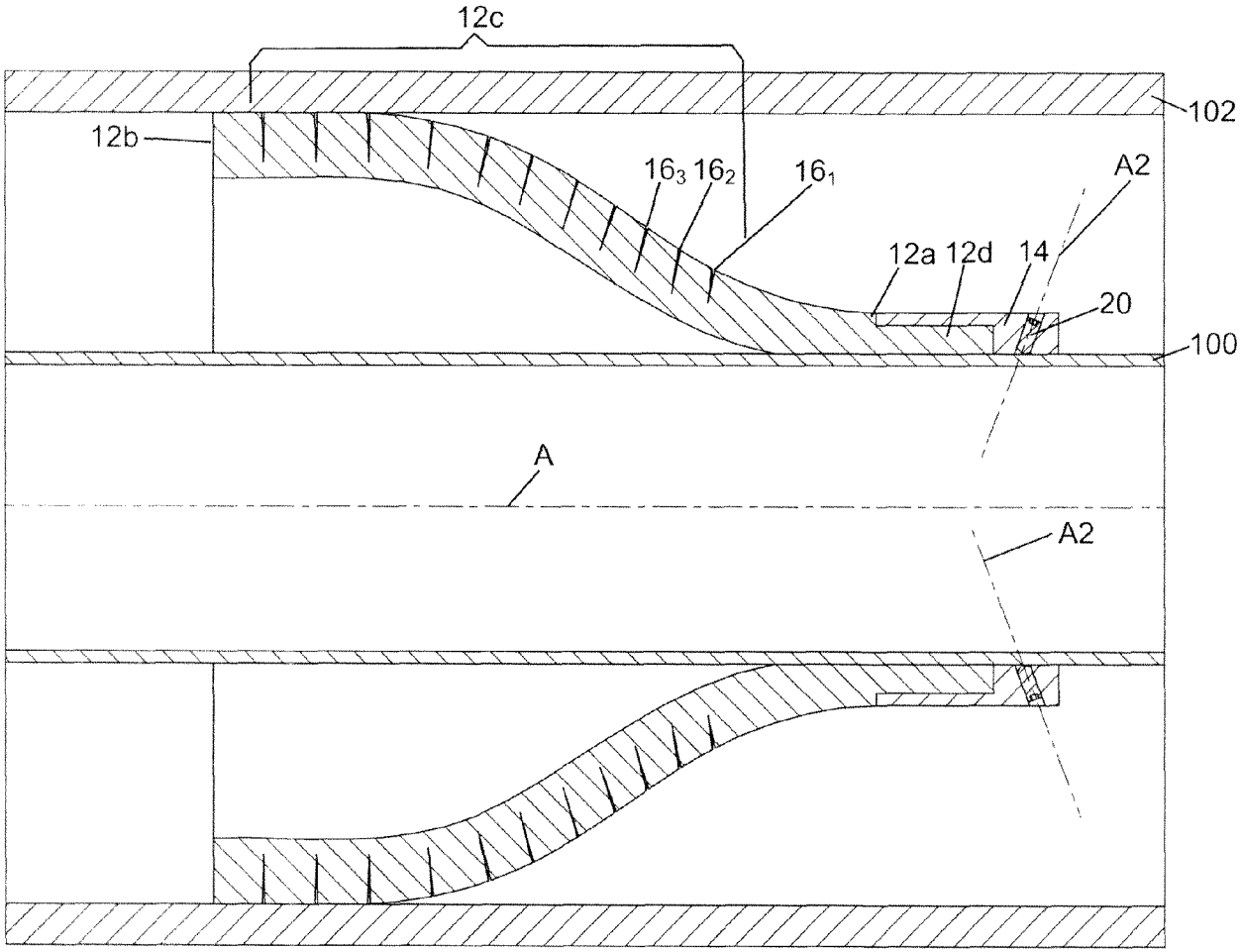
FIG. 5 shows a cross sectional view along line V-V from FIG. 3 with the seal being in an expanded state.
Figure 6:
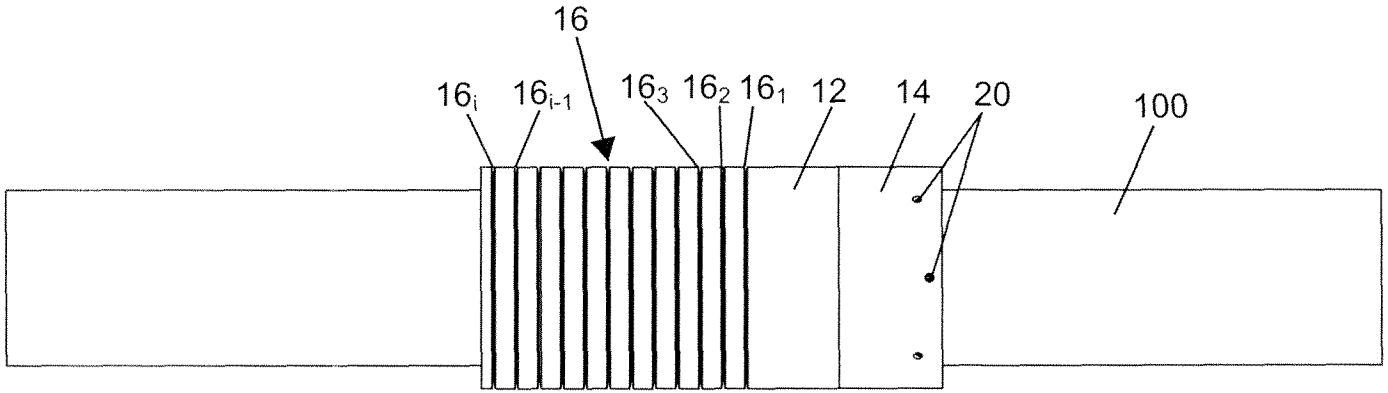
FIG. 6 shows a side view of the assembly shown in FIG. 1.

FIGS. 2 and 5 depict the assembly of FIG. 1, with the seal 10 being in an expanded state. Clearly visible is that the second end 12*b* and the intermediate section 12*c* have been moved radially outwardly so that the seal wall 12, at least adjacent the second end 12*b* is in sealing engagement with the inner surface of the outer element 102.

In an embodiment, of which an example is shown in FIGS. 1-6, the seal wall 12 may include a plurality of parallel circumferential slits $\mathbf{16}_1$, $\mathbf{16}_2$, $\mathbf{16}_3$ . . . $\mathbf{16}_{i-2}$, $\mathbf{16}_{i-1}$, $\mathbf{16}_i$. The main function of the slits $\mathbf{16}_1$, $\mathbf{16}_2$, $\mathbf{16}_3$ . . . $\mathbf{16}_{i-2}$, $\mathbf{16}_{i-1}$, $\mathbf{16}_i$ is to increase the contact surface between the swelling polymer material and the liquid that induces the swelling.

In an embodiment, the parallel slits $\mathbf{16}_1$, $\mathbf{16}_2$, $\mathbf{16}_3$ that are adjacent the first end 12*a* may be less deep than the parallel slits $\mathbf{16}_{i-2}$, $\mathbf{16}_{i-1}$, $\mathbf{16}_i$ that are more remote from the first end 12*a*. Additionally or alternatively, a distance between the parallel slits $\mathbf{16}_1$, $\mathbf{16}_2$, $\mathbf{16}_3$ that are adjacent the first end 12*a* may be larger than a distance between the parallel slits $\mathbf{16}_{i-2}$, $\mathbf{16}_{i-1}$, $\mathbf{16}_i$ that are more remote from the first end 12*a*.

By varying distance and depth, the degree and the speed of swelling may be controlled.

In an embodiment, parts of the seal sleeve wall 12 that bound a said parallel slit $\mathbf{16}_1$, $\mathbf{16}_2$, $\mathbf{16}_3$ . . . $\mathbf{16}_{i-2}$, $\mathbf{16}_{i-1}$, $\mathbf{16}_i$ abut against each other in the expanded state of the seal 10, such that the respective slit $\mathbf{16}_1$, $\mathbf{16}_2$, $\mathbf{16}_3$ . . . $\mathbf{16}_{i-2}$, $\mathbf{16}_{i-1}$, $\mathbf{16}_i$ is closed and the seal 10 obtains a more rigid structure in the expanded state.

In an expanded state of the seal 10, the seal wall 12 and more specifically, the second end 12*b* and the intermediate section 12*c* of the seal wall 12, expands radially outwardly both at the inner surface of the seal wall as well as at the outer surface of the seal wall 12. The extend of radial expansion of the second end 12*b* and the intermediate section 12*c* of the seal wall 12 is determined by the properties of the swelling polymer material used in the seal 10. However, the radial expansion may be increased by providing the seal wall 12 with circumferential slits $\mathbf{16}_1$-$\mathbf{16}_i$. In fact, the slits $\mathbf{16}_1$-$\mathbf{16}_i$ provide some space and additional flexibility to the seal wall 12 to facilitate the radial expansion of the second end 12*b* and the intermediate section. The additional flexibility of the seal wall 12 is determined by the properties of the slits $\mathbf{16}_1$-$\mathbf{16}_i$, such as the depth of the slits and the mutual spacing between the slits. To provide sufficient strength adjacent the first end 12*a* of the seal wall 12, the parallel slits $\mathbf{16}_1$, $\mathbf{16}_2$, $\mathbf{16}_3$ near the first end 12*a* of the seal wall 12 are preferably less deep and provided at smaller mutual distances than the parallel slits $\mathbf{16}_{i-2}$, $\mathbf{16}_{i-1}$, $\mathbf{16}_i$ more remote from the first end 12*a*. In addition, the parallel slits $\mathbf{16}_1$-$\mathbf{16}_i$ are preferably configured such parts of the seal wall 12 that bound the slits $\mathbf{16}_1$-$\mathbf{16}_i$ abut against each other in the expanded state of the seal 10. The parts of the wall that previously bounded the parallel slits $\mathbf{16}_1$-$\mathbf{16}_i$ may even rebond when they abut against each other in the expanded state of the seal 10, thus forming a substantially continuous seal wall 12 having a relatively a rigid and strong structure.

Figure 7:
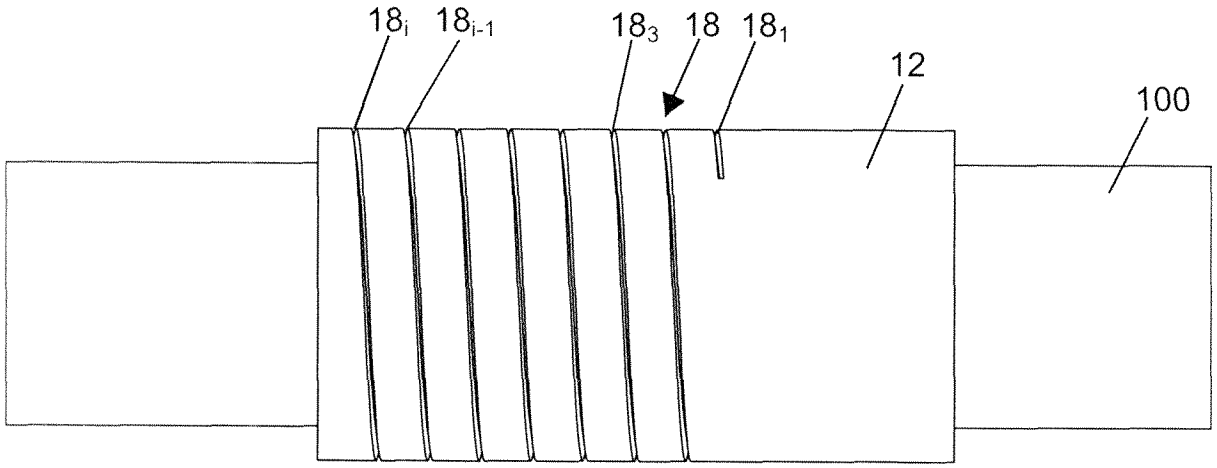
FIG. 7 shows a side view of a second example of a seal that is directly bonded on the inner element.
Figure 8:
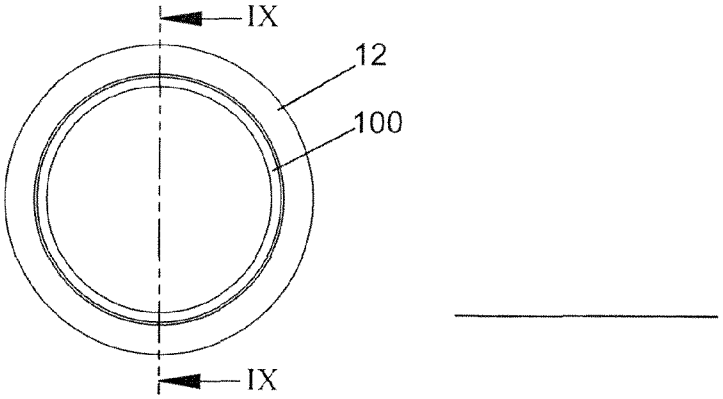
FIG. 8 shows an end view in the longitudinal direction of the assembly shown in FIG. 7.
Figure 9:
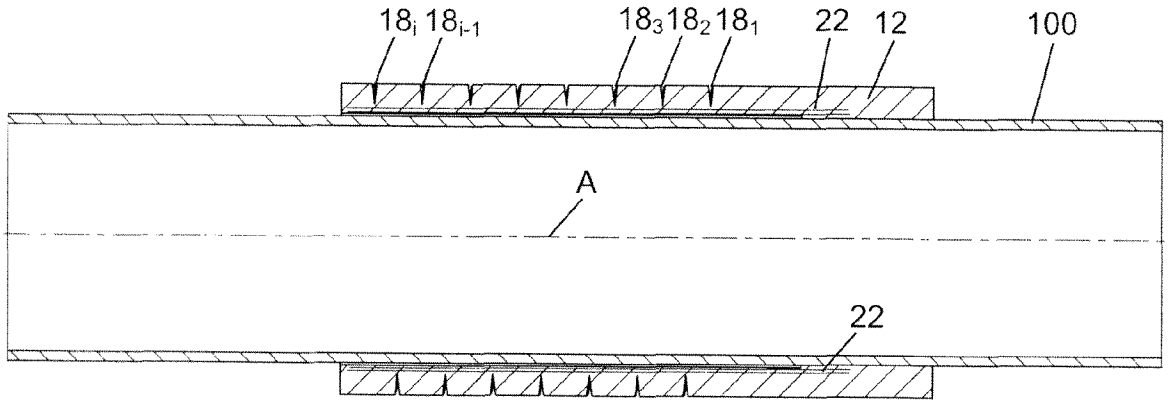
FIG. 9 shows a cross section along line IX-IX of FIG. 8.

In an alternative embodiment, of which an example is shown in FIGS. 7-9, the seal wall may comprise at least one spiral slit 18 that extends around substantially the whole length of the seal wall 12, wherein the at least one spiral slit 18 provides a plurality of windings $\mathbf{18}_1$, $\mathbf{18}_2$, $\mathbf{18}_3$ . . . $\mathbf{18}_{i-2}$, $\mathbf{18}_{i-1}$, $\mathbf{18}_i$. Again, the main function of the slit 18 is to increase the contact surface between the swelling polymer material and the liquid that induces the swelling. From a manufacturing point of view, it is advantageous to manufacture a single slit 18 instead of a plurality of parallel slits $\mathbf{16}_1$-$\mathbf{16}_i$.

In an elaboration of the invention, the windings $\mathbf{18}_1$, $\mathbf{18}_2$, $\mathbf{18}_3$ of the spiral slit 18 that are adjacent the first end 12*a* may be less deep than the windings $\mathbf{18}_{i-2}$, $\mathbf{18}_{i-1}$, $\mathbf{18}_i$ of the spiral slit that are more remote from the first end 12*a*. Additionally or alternatively, a pitch of the windings $\mathbf{18}_1$, $\mathbf{18}_2$, $\mathbf{18}_3$ of the at least one spiral slit 18 that are adjacent the first end 12*a* may be larger than a pitch of the windings $\mathbf{18}_{i-2}$, $\mathbf{18}_{i-1}$, $\mathbf{18}_i$ of the spiral slit that are more remote from the first end 12*a*. In a further embodiment of the invention, at least part of the windings $\mathbf{18}_1$, $\mathbf{18}_2$, $\mathbf{18}_3$ . . . $\mathbf{18}_{i-2}$, $\mathbf{18}_{i-1}$, $\mathbf{18}_i$ is abutted to each other, such that the seal 10 is a rigid structure.

All these variants serve to control and vary the speed and degree of swelling of the seal wall 12 along its length.

Providing the seal wall 12 with at least one spiral slit 18 may be an alternative to providing multiple circumferential slits $\mathbf{16}_1$-$\mathbf{16}_i$. The advantage of one spiral slit 18 or a limited number of spiral slits 18 over a plurality of circumferential slits $\mathbf{16}_1$-$\mathbf{16}_i$ is that one or a limited number of spiral slits 18 is/are relatively easy to manufacture by means of a lathe, while still providing the advantages associated with the plurality of parallel circumferential slits $\mathbf{16}_1$-$\mathbf{16}_i$. The limited number mentioned before may be in the range of two to five spiral slits 18. The advantages described with reference to the various embodiments of the plurality of parallel slits $\mathbf{16}_1$-$\mathbf{16}_i$ are also obtained with the various embodiments of a seal 10 having a single spiral slit 18 or a limited number of spiral slits 18 as described above.

In an embodiment, of which an example is shown in FIG. 9, the seal 10 may comprise fibers 22 to provide anisotropic swelling of the seal wall 12. The fibers 22 may be oriented such that the anisotropic swelling is provided in a substantially radially outward direction from the central axis A and that swelling in the longitudinal direction of the central axis A is substantially prevented. To that end, the fibers 22 may extend substantially parallel to the central axis A of the seal in the non-swollen state of the seal 10. In an elaboration of the invention, the fibers 22 may be aramid fibers, for example Twaron™ fibers. However, other fibers are feasible as well, such as glass, carbon, PE, polyamide and/or rope fibers. An extensive description of the application of anisotropic swelling is given in Dutch patent application no. 2011810 of which the contents are incorporated herein by reference.

Adding fibers 22 to the seal 10 may be used to introduce additional advantageous properties in the seal 10. The fibers 22 may for example be used to induce anisotropic swelling of the seal 10, thereby substantially preventing expansion in the longitudinal direction of the seal. This may result in an increased radial outwardly expansion of the second end 12*b* and the intermediate section 12*c* of the seal wall 12. Consequently, an increase in diameter may be achieved, allowing sealing of annular spaces with an even larger width than a seal 10 without fibers 22. In addition, the fibers 22 may also be used to increase the mechanical strength of the seal 10. Preferably, the fibers 22 are configured to provide both an increase in the mechanical strength and induce anisotropic swelling of the seal wall 12.

The invention also provides an assembly comprising a seal 10 according to the invention and an inner element 100 having an outer surface 102 on which the seal 10 is mounted.

Such an assembly has the same advantages that have been described in relation with the seal 10 in the summary of the present application.

In an embodiment of the assembly, of which an example is shown in FIGS. 7-9, the seal wall 12 of the seal 10 may be directly bonded on the outer surface of the inner element 100. Such an embodiment is relatively low cost because the connection ring 14 is not present. However, the advantages of a connection ring 14, including the possibility to adjust the position of the seal 10 along the length of the tubing, are not present in this embodiment.

In view thereof, an alternative embodiment of assembly comprises a seal 10 having the features of at least claims 1 and 2, and wherein the connection ring is permanently or releaseably connected with the outer surface of the inner element. Because the seal 10 is embodied as a seal sleeve, the position on the inner element 100 can be freely chosen, for example, even on site.

In an embodiment of the assembly, the assembly additionally includes an outer element 102 having an inner surface. The inner element 100 is configured to be at least partially enclosed by the outer element 102, so that a circumferential space 104 is present, which, generally, will have an annular configuration. The circumferential space 104 extends between the outer surface of the inner element 102 and the inner surface of the outer element 102. In a non-swollen state of the seal 10, the seal wall 12 and the inner wall of the outer element 102 are spaced apart. In an expanded state of the seal 10, the seal wall 12 is in sealing engagement with the outer surface from the inner element 100 at least at or adjacent the first end 12*a* the seal wall 12. In the expanded state, the seal wall 12 is in sealing engagement with the inner wall of the outer element 102 at least at or adjacent the second end 12*b* of the seal wall 12. In an embodiment of the assembly, the inner element 100 may be a production tubing of a well, and the outer element 102 may be an inner wall of a well bore hole. Alternatively, the inner element 100 may be a shaft and the outer element may be a shaft housing.

The seals 10 have in the expanded state the configuration of an umbrella and are able to withstand more pressure difference in the condition in which the pressure on the concave side of the umbrella is high relative to pressure on the convex side than in the condition in which the pressure on the concave side of the umbrella is low relative to the pressure on the convex side. In view thereof, in an embodiment of the assembly, the inner element 100 may be provided with at least two seals 10, which each have, in an expanded condition a concave side and a convex side, wherein the seals 10 are mounted in opposite directions on the inner element 100. In such an assembly, a first one of the at least two seals 10 may be directed with its concave side to a first end of the inner element 100 and a second one of the at least two seals 10 may be directed with its concave side to the second end of the inner element which is opposite the first end. Thus, the combination of the two seals 10 may withstand similar pressure difference in both longitudinal directions along the length of the inner element 100.

Finally, the invention also provides a method for applying a seal between an inner element 100 and an outer element 102. The method comprises:

- providing an inner element 100 having an outer surface 102 and an outer element 102 having an inner surface, wherein the dimensions of the inner element 100 are such that it is receivable in the outer element 102,
- providing a seal 10 according to the invention or one of the embodiments of the invention that is mounted on the inner element 100,
- inserting the inner element 100 into the outer element 102, so that a circumferential space 104 is present between the seal 10 and the outer element 102,
- applying a fluid to the circumferential space 104 to change the state of the seal from a non-swollen state to an expanded state, wherein, in the expanded state of the seal 10, the seal wall 12 is in sealing engagement with the outer surface from the inner element 100 at least at or adjacent the first end 12*a* the seal wall 12 and wherein the seal wall 12 is in sealing engagement with the inner wall of the outer element 102 at least at or adjacent the second end 12*b* of the seal wall 12.

With such a method, a strong seal between the inner element 100 and the outer element 102 may be obtained even if the circumferential space 104 has a relatively large radial width.

The various embodiments which are described above may be implemented independently from one another and may be combined with one another in various ways. The reference numbers used in the detailed description and the claims do not limit the description of the embodiments nor the claims and are solely used to clarify.

LEGEND

10—Seal
100—Inner element
12—Seal wall
12*a*—First end of seal wall 12
12*b*—Second end of seal wall 12
12*c*—Intermediate section of seal wall 12
14—Connection ring
16$_1$-16$_i$—Circumferential slits
18—Single spiral slit
18$_1$-18$_i$—Windings of single spiral slit 18
20—Threaded holes
102—Outer element
104—Circumferential space
A.—Central axis
A2.—Screw axis

The invention claimed is:

1. A seal including a seal wall of a swelling polymer material having elastomeric properties so that the seal has a non-swollen state and an expanded state, the seal wall having a closed circumference that extends around a central longitudinal axis and that extends from a first end via an intermediate section to a second end along a length in the direction of the central axis, wherein the first end of the seal wall is connected or connectable to an inner element and sealingly engages the inner element at the first end of the seal wall, wherein an inner diameter of the seal wall at the first end in the non-swollen state is the same as the inner diameter of the seal wall at the first end in the expanded state, and wherein the seal wall, apart from at and adjacent to the first end thereof, is freely radially expandable due to the fact that the second end and the intermediate section of the seal wall are not connected to any structural parts other than itself, wherein inner diameters of the seal wall at the intermediate section and at the second end are larger in the expanded state than in the non-swollen state, wherein radial thickness of the seal wall is increased in the swollen state relative to radial thickness of the seal wall in the non-swollen state, and wherein total radial expansion of the seal wall at the intermediate section and at the second end is a compounded effect from increasing radial thickness of the seal wall and increasing inner diameter and outer diameter of the seal wall at the intermediate section and at the second end due to swelling of the swelling polymer material in a circumferential direction of the seal wall.

2. The seal according to claim 1, including a single connection ring having a fixed structure and being connected to the seal wall at the first end of the seal wall, wherein the single connection ring is configured to provide a connection between the inner element and the seal.

3. The seal according to claim 2, wherein a part of the seal wall also extends at least partly at an inner surface of the connection ring.

4. The seal according to claim 2, wherein the single connection ring includes threaded holes in which bolts are screwable to provide the connection between the inner element and the seal.

5. The seal according to claim 4, wherein each threaded hole extends along an associated screw axis that includes a sharp angle with the longitudinal axis of the seal wall.

6. The seal according to claim 2, wherein the connection ring comprises metal or a metal alloy.

7. The seal according to claim 1, wherein the seal wall includes a plurality of parallel circumferential slits.

8. The seal according to claim 7, wherein the parallel circumferential slits that are adjacent the first end are less deep than the parallel slits that are more remote from the first end.

9. The seal according to claim 7, wherein a distance between the parallel slits that are adjacent the first end is larger than a distance between the parallel slits that are more remote from the first end.

10. The seal according to claim 7, wherein parts of the seal wall that bound one of the plurality of parallel circumferential slits abut against each other in the expanded state of the seal, such that the slit is closed and the seal obtains a more rigid structure in the expanded state.

11. The seal according to claim 1, wherein the seal wall includes at least one spiral slit that extends around substantially the whole length of the seal wall, wherein the at least one spiral slit provides a plurality of windings.

12. The seal according to claim 11, wherein the windings of the at least one spiral slit that are adjacent the first end are less deep than the windings of the spiral slit that are more remote from the first end.

13. The seal according to claim 11, wherein a pitch of the windings of the at least one spiral slit that are adjacent the first end is larger than a pitch of the windings of the spiral slit that are more remote from the first end.

14. The seal according to claim 11, wherein parts of the seal wall that bound one of the plurality of windings abut against each other in the expanded state of the seal, such that the winding is closed and the seal obtains a more rigid structure in the expanded state.

15. The seal according to claim 1, wherein the seal further comprises fibers to provide anisotropic swelling of the seal.

16. The seal according to claim 15, wherein the fibers are oriented such that the anisotropic swelling is provided in a substantially radially outward direction from the central axis and that swelling in the longitudinal direction of the central axis is substantially prevented.

17. The seal according to claim 15, wherein the fibers extend substantially parallel to the central axis of the seal in the non-swollen state of the seal.

18. The seal according to claim 15, wherein the fibers are aramid fibers.

19. The seal according to claim 1, wherein the seal exclusively consists of the seal wall.

20. The seal according to claim 2, wherein the seal exclusively consists of the seal wall and the single connection ring.

21. An assembly comprising a seal according to claim 1 and an inner element having an outer surface on which the seal is mounted.

22. The assembly of claim 21, wherein the seal only includes the seal wall, wherein the seal wall of the seal is directly bonded on the outer surface of the inner element.

23. The assembly of claim 21, wherein the seal includes a single connection ring having a fixed structure and being connected to the seal wall at a first end of the seal wall, wherein the single connection ring is permanently or releaseably connected with the outer surface of the inner element.

24. The assembly of claim 21, including an outer element, wherein the inner element is at least partially enclosed by the outer element so that a circumferential space is present that extends between the outer surface of the inner element and an inner surface of the outer element, and wherein the seal wall and the inner surface of the outer element are spaced apart in a non-swollen state of the seal, and wherein in an expanded state of the seal the seal wall is in sealing engagement with the outer surface of the inner element at least at or adjacent the first end the seal wall and wherein the seal wall is in sealing engagement with the inner surface of the outer element at least at or adjacent the second end of the seal wall.

25. The assembly according to claim 24, wherein the inner element is a production tubing, and the outer element is an inner wall of a well bore hole.

26. A method for applying a seal between an inner element and an outer element, the method comprising:

providing an inner element having an outer surface and an outer element having an inner surface, wherein the dimensions of the inner element are such that it is receivable in the outer element, providing a seal according to claim 1 that is mounted on the inner element;

inserting the inner element into the outer element, so that a circumferential space is present between the seal and the outer element, applying a fluid to the circumferential space to change the state of the seal from a non-swollen state to an expanded state, wherein, in the expanded state of the seal the seal wall is in sealing engagement with the outer surface of the inner element at least at or adjacent the first end of the seal wall and wherein the seal wall is in sealing engagement with the inner surface of the outer element at least at or adjacent the second end of the seal wall, wherein an inner diameter of the seal wall at the first end in the non-swollen state is the same as the inner diameter of the seal wall at the first end in the expanded state, and wherein inner diameters of the seal wall at the intermediate section and at the second end are larger in the expanded state than in the non-swollen state, wherein radial thickness of the seal wall is increased in the swollen state relative to radial thickness of the seal wall in the non-swollen state, and wherein total radial expansion of the seal wall at the intermediate section and at the second end is a compounded effect from increasing radial thickness of the seal wall and increasing inner diameter and outer diameter of the seal wall at the intermediate section and at the second end due to swelling of the swelling polymer material in a circumferential direction of the seal wall.

* * * * *